United States Patent [19]

Paddock et al.

[11] Patent Number: 4,903,308

[45] Date of Patent: Feb. 20, 1990

[54] AUDIO TRANSDUCER WITH CONTROLLED FLEXIBILITY DIAPHRAGM

[75] Inventors: Paul W. Paddock, McMinnville; Steven R. Geist, Portland, both of Oreg.

[73] Assignee: Linaeum Corporation, Portland, Oreg.

[21] Appl. No.: 154,945

[22] Filed: Feb. 10, 1988

[51] Int. Cl.[4] ..... H04R 7/02; H04R 1/02; H04R 7/12; H04R 9/04

[52] U.S. Cl. ..... 381/202; 181/153; 181/164; 181/166; 181/171; 181/172; 181/173; 381/153; 381/185; 381/186; 381/193; 381/194; 381/195

[58] Field of Search ..... 381/202, 192, 196, 199, 381/200, 201, 185, 186, 191; 181/148, 153, 164, 166, 171, 173, 172, 150

[56] References Cited

U.S. PATENT DOCUMENTS

| | | | |
|---|---|---|---|
| 1,560,502 | 11/1925 | DeForest | 381/202 |
| 1,638,245 | 8/1927 | Davis | 181/172 |
| 1,667,149 | 4/1928 | Gerlach | 381/202 |
| 1,668,509 | 5/1928 | Koch | 381/192 |
| 1,672,796 | 6/1928 | Whitmore | 181/163 |
| 1,698,374 | 1/1929 | Pack | 181/171 |
| 1,735,860 | 11/1929 | Hutchison | 181/144 |
| 1,740,161 | 12/1929 | Duffy | 181/173 |
| 1,788,385 | 1/1931 | Duffy | 181/173 |
| 1,821,469 | 9/1931 | Hicks | 181/173 |
| 1,831,484 | 11/1931 | Duffy | 181/164 |
| 1,845,585 | 2/1932 | Duffy | 181/166 |
| 1,859,892 | 5/1932 | Ricker | 181/163 |
| 1,862,582 | 6/1932 | Schlenker | 381/166 |
| 1,864,615 | 6/1932 | Quinby | 381/152 |
| 1,866,090 | 7/1932 | DeForest | 381/186 |
| 1,895,494 | 1/1933 | Smythe | 181/164 |
| 1,900,111 | 3/1933 | Hicks | 181/173 |
| 1,930,186 | 10/1933 | Swallow | 381/186 |
| 2,013,695 | 9/1935 | Nicolson | 381/156 |
| 3,093,207 | 6/1963 | Bozak | 181/167 |
| 3,456,755 | 7/1969 | Walker | 381/158 |
| 3,477,540 | 11/1969 | Rizo-Patron | 381/158 |
| 3,685,609 | 8/1972 | Franssen | 181/163 |
| 3,686,446 | 8/1972 | Manger | 381/195 |
| 3,699,249 | 10/1972 | Crane et al. | 358/279 |
| 3,747,880 | 7/1973 | Bock | 181/148 |
| 3,858,680 | 1/1975 | Tsuge | 181/167 |
| 3,973,150 | 8/1976 | Tamura et al. | 381/190 |
| 3,976,897 | 8/1976 | Tamura et al. | 381/190 |
| 3,978,353 | 8/1976 | Kinoshita | 381/190 |
| 3,985,201 | 10/1976 | Kloster | 181/163 |
| 4,029,171 | 6/1977 | Manger | 181/167 |
| 4,140,203 | 2/1979 | Niguchi et al. | 181/170 |
| 4,173,701 | 11/1979 | Murata et al. | 181/157 |
| 4,458,249 | 12/1985 | Lerch et al. | 381/190 |
| 4,464,785 | 8/1984 | Kagdis | 381/195 |
| 4,472,605 | 9/1984 | Klein | 381/186 |
| 4,584,439 | 4/1986 | Paddock | 381/194 |

FOREIGN PATENT DOCUMENTS

| | | | |
|---|---|---|---|
| 1251381 | 10/1967 | Fed. Rep. of Germany . | |
| 2063662 | 7/1971 | Fed. Rep. of Germany . | |
| 2461258 | 7/1976 | Fed. Rep. of Germany | 381/202 |
| 2759331 | 9/1979 | Fed. Rep. of Germany . | |
| 3123098 | 1/1983 | Fed. Rep. of Germany | 381/191 |
| 54-118816 | 9/1979 | Japan . | |
| WO80/01128 | 5/1980 | PCT Int'l Appl. . | |
| WO87/02559 | 10/1987 | PCT Int'l Appl. . | |
| 451178 | 7/1936 | United Kingdom | 381/186 |

OTHER PUBLICATIONS

"Tedlar PVF Film," Du Pont Company Fabricated Products Department, E-42048 (6/87).

*Primary Examiner*—Jin F. Ng
*Assistant Examiner*—Danita R. Byrd
*Attorney, Agent, or Firm*—Klarquist, Sparkman, Campbell, Leigh & Whinston

[57] ABSTRACT

An improved audio transducer includes a diaphragm having a pair of cylindrically-shaped webs that provide greater bandwidth, reduced distortion and greater horizontal dispersion of sound. The audio output of the transducer is further improved by forming the diaphragm of a polyvinyl fluoride film. Other improvements include the use of damping pads to damp internal sound waves and damping strips on the diaphragm to minimize distortion at the resonant frequency of the transducer.

11 Claims, 2 Drawing Sheets

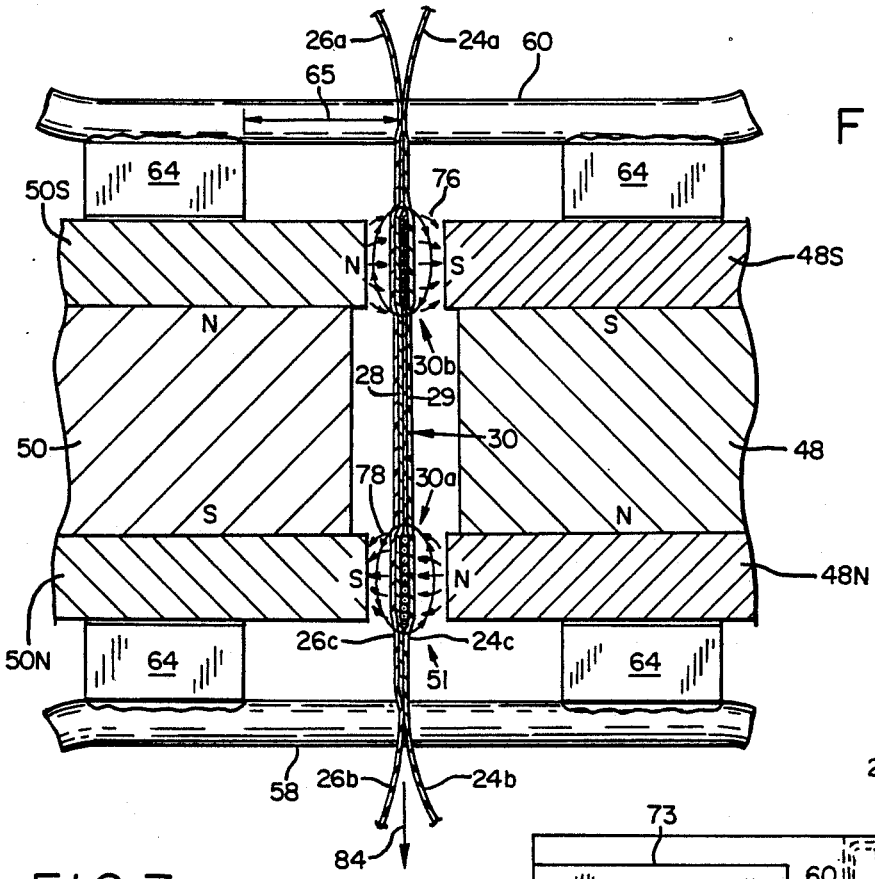
FIG. 4
FIG. 5
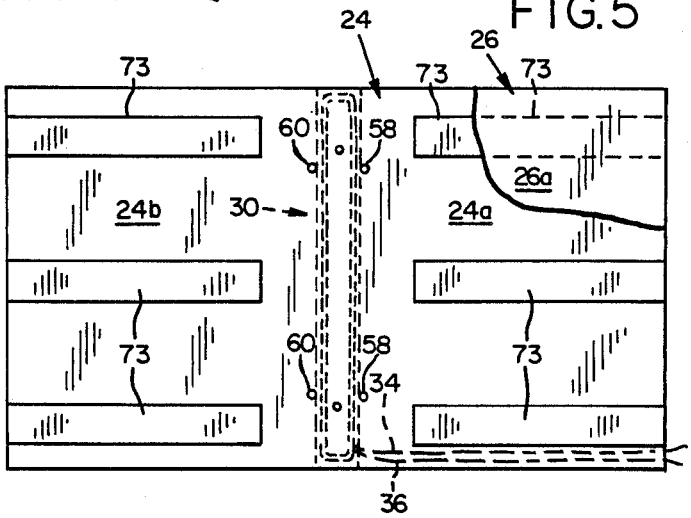
FIG. 7
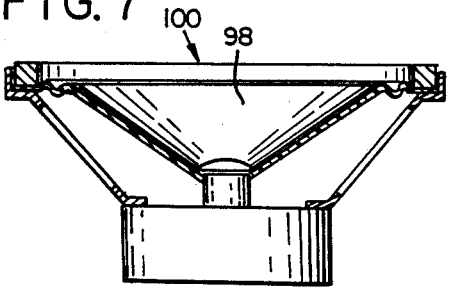
FIG. 6
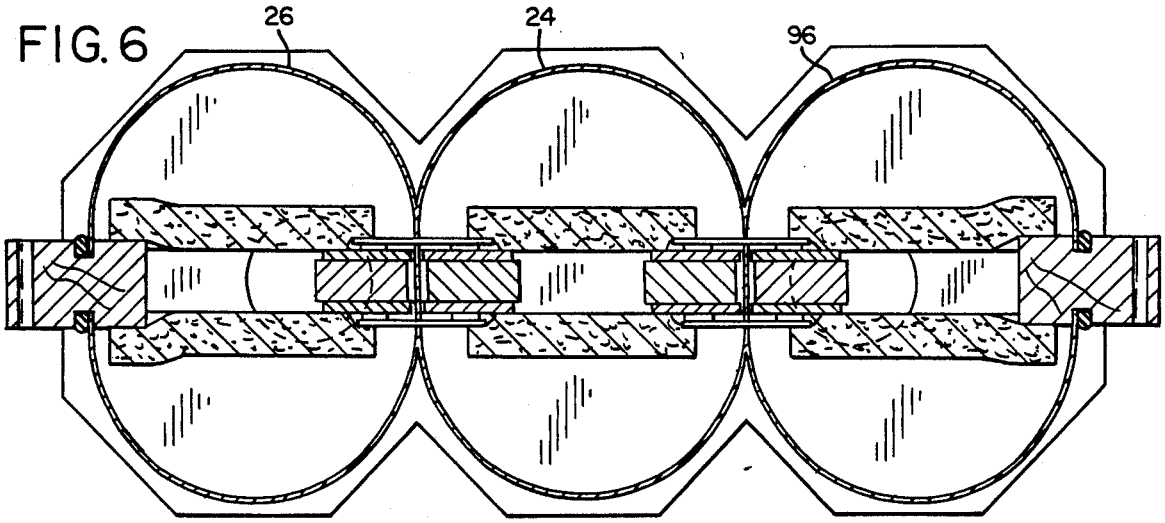

AUDIO TRANSDUCER WITH CONTROLLED FLEXIBILITY DIAPHRAGM

BACKGROUND OF THE INVENTION

This invention generally relates to audio transducers. More particularly, the invention relates to improvements in the design of a transducer diaphragm having a pair of elongate resilient webs whose intermediate portions form an expanse that extends generally in a plane and that is mounted for movement in the direction of the plane.

Various types of audio transducers, as exemplified by audio loudspeakers, are known in the prior art. One common form of transducer comprises a cone with an attached electromagnetic motor driving element. The cone is mounted to a frame by a flexible expanse which bounds the perimeter of the cone. This type of transducer is generally characterized by a relatively high diaphragm and coil mass which creates high inertial forces in the diaphragm. These forces limit the ability of the diaphragm to vibrate at high frequencies and thus reduce its frequency response drastically at frequencies above 5 kHz. Conversely, if the diaphragm and coil instead are of relatively low mass to raise the upper end of the frequency response, the diaphragm has a reduced low frequency response. In addition to a limited frequency response, the cone-shaped diaphragm is typically molded from a paper product which renders it susceptible to changes in relative humidity. This alters the frequency response and limits the life of the transducer.

Another type of loudspeaker known in the art comprises a horn type speaker having a flat diaphragm which oscillates normal to the plane of the diaphragm in response to activation by an electromagnetic driving element. As with the cone-shaped diaphragm, the flat diaphragm portion is mounted to a frame by means of an annular portion bounding a flat central portion. In some instances, the diaphragm may be suspended from a voice coil to which it is directly attached. With this type of speaker a large horn is required to direct and focus properly the sound waves produced. Again, by reason of the mass of the diaphragm and voice coil, the frequency response of the transducer tends to drop off at high frequencies. The transducers just described furthermore tend to be very expensive.

Such prior audio transducers generally have a limited bandwidth and are optimized for specific frequency ranges such as low, mid, and high frequencies. To provide adequate frequency response over the entire audio spectrum, three or four types or sizes of transducers must be incorporated into a single cabinet. The additional transducers drastically increase the cost of high quality sound reproduction. Moreover, the use of multiple transducers requires the incorporation of complex crossover networks to isolate audio signals traveling to or emanating from the individual transducers.

U.S. Pat. No. 4,584,439, which is incorporated by reference herein, discloses an audio transducer that I invented which overcomes to a large degree the shortcomings and difficulties indicated above. The embodiment described therein includes a diaphragm having a pair of elongate resilient webs whose intermediate portions form an expanse extending generally in a plane and having curved end portions which extend laterally away from the plane to terminate at remote frame locations. The webs thus appear from a top view as a pair of back-to-back "C"s joined at their midpoints. The expanse is supported in the frame by string-like supports to allow the expanse to move in the direction of the plane. To complete the diaphragm, a wire coil is attached to the expanse and magnets are mounted on opposite sides of the expanse to provide a magnetic field across the expanse. Current in the coil proportional to received audio impulses creates a magnetic field that interacts with the existing magnetic field to vibrate the webs and generate sound waves thereby.

The embodiment disclosed therein, however, still suffers from several drawbacks in practical application. The bandwidth, although improved, is somewhat limited. The lower cutoff frequency, it was found, is typically around 1200 Hz rather than the hoped-for cutoff of 100 Hz. The diaphragm also suffers from reflections of waves in the web material at the locations where the webs terminate in the frame. The reflected waves distort the amplitude response of the diaphragm by canceling some waves in the web and doubling others so that the amplitude of the sound produced is uneven. A third drawback of the prior transducer is its broad band material resonance. The shape of the frame, combined with the diaphragm and string-like materials, produces distorting resonance around 1 kHz. Still another problem with the prior design is the limited horizontal dispersion. Sound from the transducer radiates forward in about a 30° arc from the central expanse, leaving much of a room without direct exposure to the sound.

SUMMARY OF THE INVENTION

An object of this invention, therefore, is to provide an improved transducer featuring a construction which overcomes the difficulties and shortcomings indicated.

More specifically, an object of the invention is to provide a transducer with an improved diaphragm construction that increases the transducer bandwidth and decreases distortion.

Another object of the invention is to provide a transducer with a diaphragm constructed from a material that significantly decreases distortion.

Still another object of the invention is to provide a transducer with a diaphragm constructed to dispense sound over a wider arc.

To achieve these objects, an improved transducer according to the present invention includes resilient webs that each extend from a central expanse in an arc to a remote frame location substantially aligned through the expanse with the other frame location. In one embodiment of the invention, each web may extend in opposite arcs to form a substantially cylindrically shaped web. The pair of webs so shaped provide greater bandwidth, reduced distortion and greater horizontal dispersion of sound.

The performance of the transducer is further improved by forming the diaphragm from polyvinyl fluoride film. This material has superior flexing characteristics that improve the frequency response in the high range.

Other improvements include unique damping pads and damping strips as well as frame shape to further enhance the sound reproduction.

These and other objects and advantages of instant invention will become more fully apparent as the description which follows is read in conjunction with the accompanying drawings.

DESCRIPTION OF THE DRAWINGS

FIG. 4 is a greatly enlarged view of a portion of FIG. 2 where the coil and magnets of the transducer are located.

FIG. 5 is a side view of the webs.

FIG. 6 is a cross-sectional view of another embodiment of the transducer.

FIG. 7 is a side view of a conventional cone loudspeaker in which the diaphragm is constructed of polyvinyl fluoride film.

DETAILED DESCRIPTION

Figure 1:
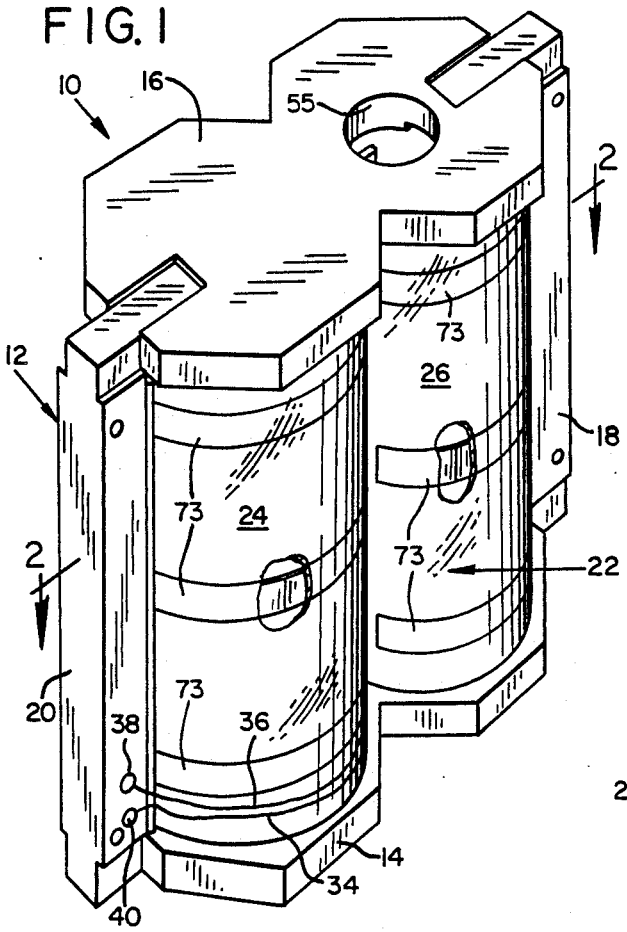
FIG. 1 is a perspective view of a transducer according to the present invention.

Turning now to the drawings, and particularly to FIGS. 1 through 4, an audio transducer according to the present invention is shown generally at 10. The transducer described herein is intended for use as an audio loudspeaker. It should be understood, however, that use of the transducer is not so limited and is also suitable for, and functions quite efficiently as, a microphone.

Transducer 10 includes a frame 12 having a double octagonal-shaped bottom member 14, a double octagonal-shaped top member 16, and opposing rectangular side members 18, 20 which interconnect and are rigidly attached to the top and bottom members. It has been determined that the segmented edge of bottom and top members 12 and 14 is more effective than a straight or curved edge at breaking up sound waves that vertically emanate from the surface of webs 24 and 26 of diaphragm 22, to be described. These sound waves, on encountering a smooth surface such as a curve, may be absorbed at certain wavelengths and thus increase signal distortion. Frame 12 may be constructed of any suitable material of fairly high density and which has desirable acoustic properties, such as aluminum or particle board. The frame may also be formed of injection molded plastic. It has also been determined that by reducing the mass of the frame 12 from the prior design to the present design, the material resonant frequency has been shifted outside the frequency range of the transducer 10.

Figure 2:
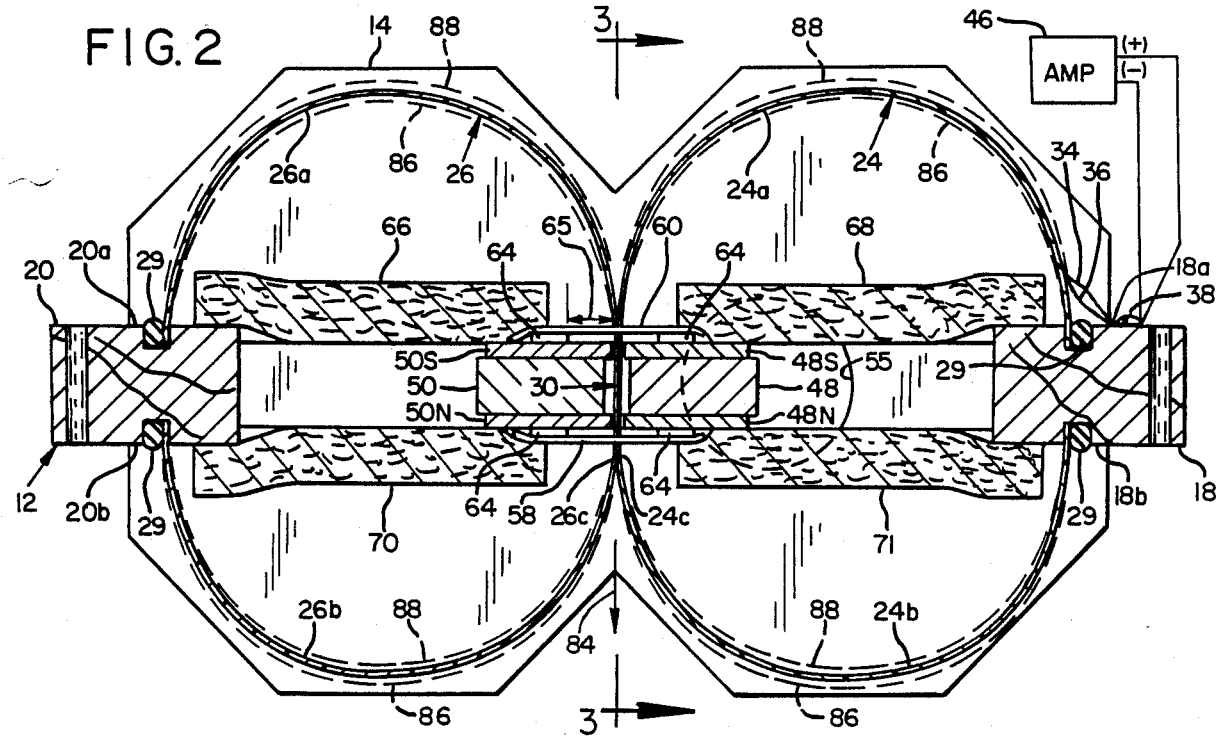
FIG. 2 is an enlarged cross-sectional view of the transducer taken along line 2—2 of FIG. 1.

The transducer diaphragm is shown generally at 22 and includes in the present embodiment a pair of elongate resilient webs 24, 26. Each web includes flexible curved portions forming the ends of each web, joined to, and extending from, an intermediate, generally planar expanse. With reference now to FIG. 2, web 24 includes curved portions **24*a*, 24*b* and a central expanse 24*c* and web 26 includes the curved portions 26*a*, 26*b* and a central expanse 26*c*. The central expanses 24*c*, 26*c* of the two webs are joined together, as with an adhesive 28 best seen in FIGS. 3 and 4**, into a joined central expanse. The joined central expanse, or diaphragm intermediate portion, may be thought of as an intermediate slack portion, with such being movable generally in the plane occupied by the expanse.

The joined central expanse is supported on the frame 12 by the flexible curved portions at the ends of the diaphragm. Referring again to FIG. 2, each of the flexible end portions **24*a*, 24*b*, 26*a*, 26*b* extends in an arc from the joined central expanse to terminate in elongated slots at remote but adjacent frame locations 18*a*, 18*b* and adjacent locations 20*a*, 20*b*, respectively, on the outer portion of the front and rear edges of members 18, 20. Location 18*a* is substantially aligned with location 20*a* through the central expanse formed by web portions 24*c*, 26*c*. Location 18*b* is similarly aligned with location 20*b*. It has been determined that the extended arcuate configuration of the webs improves the prior transducer in at least three respects: the greater arc significantly reduces the reflection of waves in the web at the frame boundary location to improve the amplitude response; it lowers the frequency cutoff to about 150 Hz; and it increases the horizontal dispersion of sound waves from 30° to nearly 180° . The improved, unique web shape causes more of the wave motion in the web to be dissipated into the air and less of the motion to be reflected back into the web to embodiment, the arcs of web portions 24*a* and 24*b* are semicircular and opposite in direction to form a substantially cylindrically shaped web 24. Similarly, the arcs of web portions 26*a* and 26*b* are semicircular and opposite in direction to form a substantially cylindrically shaped web 26. It will be appreciated, however, that various combinations of arcs could be employed to form the cylindrically shaped webs. Diaphragm webs 24, 26 are secured at each end to frame 12 by attaching each end portion to an isolation strip 29 extending the length of the elongated slot at each frame location 18*a*, 18*b*, and 20*a*, 20*b*. This arrangement insures that vibrations produced by the diaphragm are only minimally transmitted to the frame, enabling the diaphragm to expend most of its energy producing sound waves. The isolation strips 29 may be made of a suitable shock-absorbing porous or fibrous material, such as foam rubber or felt. Strips 29** are removable for ease of disassembly. Alternatively, the end web portions may be glued directly to the frame.

Figure 3:
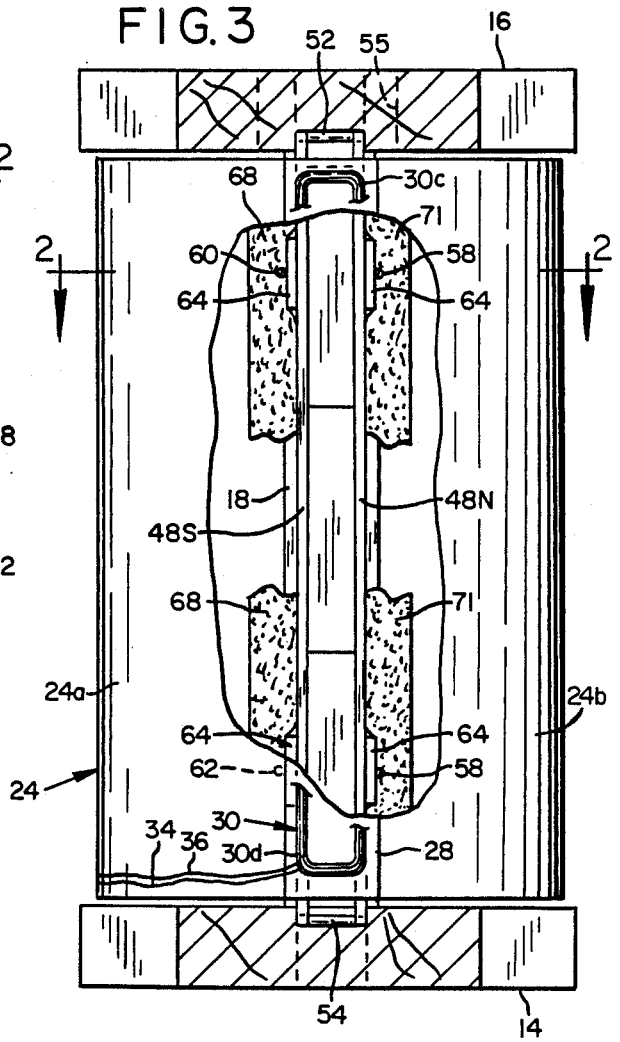
FIG. 3 is an enlarged median sectional view, taken along line 3—3 in FIG. 2, showing the configuration of a coil in schematic form.

Referring now to FIGS. 3 and 4, means such as an electromagnetic coil 30 is attached to the expanse of diaphragm 22 and is substantially enclosed by webs 24, 26 at their slack, intermediate portions **24*c*, 26*c*. Coil 30 is an elongate looped coil in the present embodiment and contains an ascending portion 30*a*, a descending portion 30*b*, and an upper and lower transverse portions 30*c*, 30*d*, respectively. Coil 30 may be formed of 10 turns of 36 gauge silver wire and is glued directly in place on web portions 24*c*, 26*c* with adhesive 28. The two web portions 24*c*, 26*c* are then glued together with an adhesive 29 placed within the interior of coil 30. A pair of leads 34, 36 from coil 30 runs to frame side member 18 where they terminate in connectors 38, 40, respectively, seen best in FIG. 1. Connectors 38, 40 comprise means for connecting the coil 30 to a signal source such as an amplifier 46 for conducting electrical impulses between the coil and the source. The amplifier 46** generates alternating current impulses proportional to audio signals, which impulses shift polarity between 20 and 20,000 times per second.

Two sets of opposed magnets 48, 50 are mounted to the interior of the frame and held in place in retaining grooves cut in bottom and top members 14 and 16, respectively. Magnets 48, 50 may be of the metal bar-magnet type or, as in the present embodiment, high quality (strontium ferrite) ceramic magnets standard in the industry, fastened together in a stacked manner with adhesive. The magnets must be polarized across their major faces, as indicated in FIG. 4, for the transducer to properly function. Two pairs of magnetically permeable plates 48N, 48S and 50N, 50S made from low carbon (0.003%) steel are attached to the major faces of magnets 48, 50, respectively. An opposing magnetic field is established by polarizing the plates 48N and 50N to a north magnetic pole and polarizing plates 48S and 50S to a south magnetic pole. The plates thus produce an opposing magnetic field, whose lines of flux are normal to the expanse of diaphragm 22 across a gap 51 shown in FIG. 4. Magnets 48 and 50 are separated by a pair of nonferrous spacers 52, 54 shown in FIG. 3. The spacers in the preferred embodiment are copper rods which maintain the spacing 51 between magnets 48 and 50. In the present method of construction, the magnets 48, 50 are inserted through holes defined in the top and bottom members 14 and 16, such as hole 55 shown in FIGS. 1–3. These holes may then be plugged with felt (not shown) to complete the frame.

The diaphragm central expanse is supported and centered by upper and lower elastomeric cords 56, 58, 60, 62 such that coil portions **30*a* and 30*b* are each aligned with the magnetic field created by the adjacent permeable plates, as illustrated in FIG. 4. Each cord is secured at opposite ends to a neoprene spacer 64 adhered to the outer surface of each magnetically permeable plate. Each cord passes through an opening in the expanse sized to create an interference fit, such that the cord secures and yet resiliently supports the expanse. The length of cord on each side of the expanse as indicated at 65 in FIG. 2** determines the low frequency below which the frequency response of the diaphragm is attenuated. Such attenuation is desirable because the lower frequency response in a diaphragm has a greater amplitude and must be attenuated to improve the overall response. It has been determined that a cord length of ½ inch, with the cord fastened ¼ inch away from each side of the expanse, satisfactorily attenuates frequencies below 100 Hz.

Affixed to each side of the central portion of members 18 and 20 is a means for damping the frequency response of the diaphragm above a predetermined cutoff frequency. This means may comprise felt pads 66, 68, 70, 71 mounted, respectively, within the arc of each web portion **24*a*, 24*b*, 26*a* and 26*b*. More specifically, a pair of felt pads 66, 70 or 68, 71 are located inside the cylindrical surface of each web 24, 26 and are attached at one edge to one side member 18 or 20 of the frame and at its opposed edge to the stacked magnets. The pads are each preferably sized to match the web height and extend substantially from the diaphragm central expanse to each of the remote frame locations 18*a*, 18*b*, 20*a* and 20*b*. The damping pads 66, 68, 70, and 71 damp sound waves that are generated within each cylindrically shaped web above a predetermined cutoff frequency. These sound waves otherwise interfere with the waves in the web material, acting to reinforce and cancel different waves. However, below a predetermined frequency, such internal sound waves are desirable to reinforce low frequency waves. The pads 66, 68, 70, 71** are chosen to slow the wave velocity to a rate at which such reinforcement occurs. It has been determined experimentally that felt of at least 80% wool content damps the frequency response above 500–700 Hz while slowing the wave velocity sufficiently to reinforce the lower frequency response.

The present transducer as best seen in FIG. 1 will have a resonant frequency dependent on the specific transducer size and the material employed. As shown in FIGS. 1 and 5, parallel strips of damping tape 73 are adhered at predetermined locations on the inside of each web end portion **24*a*, 24*b*, 26*a* and 26*b*. The strips of tape, preferably made of a woven fiberglass such as is found in strapping tape, aids in flattening the amplitude response and reduces harmonic distortion resulting from the device's resonant frequency and its multiples. Best results have been obtained with a damping tape mass of about ⅓ of the mass of the diaphragm 22**, divided into strips spaced equidistantly apart from near the end of each web portion to the edge of the central diaphragm expanse. While three parallel damping strips are shown, it will be appreciated that an increased number f parallel damping strips spaced equidistantly but closer together also works well.

Turning now to FIGS. 2 through 4, the workings of transducer 10 will be further explained. An electrical impulse arriving at connectors 38, 40 is transmitted to coil 30. Since coil 30 is a continuous loop, a flow of current is established in the coil, thereby producing a magnetic field about the coil. Current flow is represented in the coil 30 of FIG. 4 by flow indicators showing current going into the drawing at **30*b* and out of the drawing at 30*a*. Lines of magnetic flux between plates 48N and 50S are indicated by the arrows at 76, and the magnetic flux between plates 50N and 48S are indicated by the arrows at 78**.

. The location of the plates on either side of magnets 48, 50 produces a uniform external magnetic field through the wire of coil 30. As current passes through coil 30, resultant lines of magnetic induction are established, which essentially form a clockwise field around descending loop **30*b* and a counterclockwise field around ascending loop 30*a***.

The motion of a charged wire within a magnetic field is determined by the direction of current in the wire relative to the lines of magnetic flux. At any point where the two fields meet, the resultant magnetic induction will be the vector sum of the external field and the magnetic induction field associated with the current in the wire.

In the situation depicted, amplifier 46 has a "positive" lead connected to connection 38 and a "negative" lead connected to connection 40. This results in a current flow as depicted in FIG. 4. Under the influence of the current produced by amplifier 46, coil 30 will tend to move in the direction indicated by arrow 84. When the amplifier alternates current flow, current flow in coil 30 reverses, moving the coil and the diaphragm in a direction opposite that of arrow 84.

It should be obvious to those skilled in the art that were coil 30 surrounded by a single, nonopposing magnetic field, the result of a current passing through coil 30 would be a torsional movement of the coil about its major axis, rather than a linear movement of the coil as is produced by the arrangement of the present invention.

Amplifier 46 produces a current of varying amplitude, thereby producing a resultant induced field about coil 30 of varying amplitude. The result is an oscillation of coil 30, and a resultant oscillation of diaphragm 22 of varying travel distance relative the permanent opposing magnetic fields established by magnets 48 and 50. A decrease in current amplitude within coil 30 results in a collapse of the induced magnetic field and produces a resultant movement in coil 30 and diaphragm 22 in a direction opposite that shown by arrow 84.

Thus, as shown by the phantom lines in FIG. 4, diaphragm 22 is free to deform along its flexible curved portions in response to movement induced by coil 30. Movement of the diaphragm in the direction of arrow 84 results in diaphragm 22 assuming the shape illustrated by the dash-double-dot line 86, while movement of the diaphragm opposite that of arrow 84 results in the configuration shown by dash-dot line 88. Movement of the diaphragm between these two representative positions is accomplished through a linear rolling-type action in that the flexible curved end portions deform to some extent, while the movable intermediate expanse remains substantially unflexed and continues to move within a plane defined by the central expanse of the diaphragm. Unlike the prior embodiment described in my U.S. Pat. No. 4,584,439, the rolling motion herein decreases substantially as the diaphragm flexes toward the remote frame locations 18*a*, 18*b* and 20*a*, 20*b*. The additional extent of diaphragm 22 thus minimizes wave reflection and improves the amplitude response.

The improved embodiment of the present invention has been tested and has been found to have an essentially flat frequency response from about 150 Hz to 20 kHz, with harmonic distortion of less than 1%. This data compares favorably against the harmonic distortion of 5% to 10% found in high quality, conventional loudspeakers. Additionally, the transducer 10 has been found to have a nominal impedance of 5 ohms and to perform satisfactorily with a power input between 15 and 300 watts.

In addition to the substantially cylindrically shaped web, another primary reason for the improved performance of the transducer 10 is the use of a polyvinyl fluoride (PVF) film such as TEDLAR manufactured by the E. I. DuPont Co. in forming the diaphragm webs 24, 26. It has been discovered that PVF film has superior flexing characteristics for transducer diaphragms. PVF film provides a much "flatter" frequency response in the higher frequency range, 8 kHz to 20 kHz, than previously used materials, such as Mylar. For example, amplitude variation across the higher frequency range was reduced from 12 dB with Mylar to less than 1 dB with PVF film. This material thus provides a sound that does not exhibit the "harsh" or "bright" characteristics typical of the sound produced by transducers in this frequency range. Moreover, PVF film can be heat-molded into other diaphragm shapes, such as dome or cone-shaped diaphragms, one of which is shown as 98 in a conventional loudspeaker 100 in FIG. 7. An advantage of PVF film is that it may be used to form diaphragms in both magnetic-based transducers and electrostatic-based transducers as well.

With the present invention, a plurality of transducers 10 may be incorporated into a single cabinet. Since the transducer 10, when used as a loudspeaker, radiates sound waves bi-directionally, it may be desirable to include some baffling in a speaker cabinet to prevent "dead-spots", which may result from sound wave cancellation at certain points in the listening room. When the transducer is used as a microphone, however, it is bi-directionally sensitive, producing a microphone with a figure eight sensitivity pattern.

The transducer may be constructed with diaphragm webs of varying thicknesses and coils of varying electrical characteristics in order to produce a transducer which will respond within predetermined frequency ranges. Several transducers with differing sound-reproducing characteristics may be incorporated in a single loudspeaker cabinet and connected by means of a simple crossover network to respond to electrical impulses representing a particular frequency range.

The overall construction of the transducer enables production of the units without the need for complex, highly accurate placement of component parts. Component parts are readily available, and with simple construction techniques, enable production with minimal financial expenditures.

When the transducer is constructed for use as a microphone, the diaphragm webs are formed of PVF film and the coil is formed of 50 gauge or finer wire.

Having illustrated and described the principles of the invention in a preferred embodiment, it should be apparent to those skilled in the art that the invention can be modified in arrangement and detail without departing from such principles. For example, FIG. 6 shows another embodiment of the transducer 10 in which an additional web 96 has been added. And, as stated, FIG. 7 shows the diaphragm 98 made of PVF film in a conventional loudspeaker 100, whether of the magnetic or electrostatic type. We claim all modifications coming within the spirit and scope of the following claims.

We claim:

1. An audio transducer, comprising:

a frame;

a diaphragm comprising a pair of elongate resilient webs having portions joined to each other to form a movable expanse extending substantially in a plane, the expanse being movable in the direction of the plane, the webs each having a flexible end portion extending from the expanse in an arc to a remote frame location, each frame location substantially aligned through the expanse with the other remote frame location;

coil means attached to the expanse of the diaphragm;

magnetic means for producing opposing magnetic fields extending normal to the expanse; and connecting means for conducting electrical impulses to the coil means.

2. The audio transducer of claim 1 including dampening means mounted to the frame within the arc of each web portion and spaced apart from the diaphragm for dampening the frequency response of the diaphragm above a predetermined cutoff frequency.

3. The audio transducer of claim 2 wherein the dampening means comprises a felt pad within the arc of each web, the felt pad sized to extend substantially from the expanse to the remote frame location.

4. The audio transducer of claim 1 including an elastomeric supporting cord extending through the expanse for attenuating the frequency response of the diaphragm below a predetermined frequency, the cord being fastened a predetermined distance on each side of the expanse to control the extent of expanse movement in the direction of the plane in response to electrical impulses.

5. The audio transducer of claim 1 wherein the diaphragm webs are each formed of a polyvinyl fluoride film.

6. The audio transducer of claim 1 including a damping strip attached near the end portion of each web and extending longitudinally therefrom toward the edge of the expanse to limit harmonic distortion of the diaphragm.

7. The audio transducer of claim 6 wherein the damping strips comprise at least a pair of parallel strips near the end portion of each web.

8. An audio transducer, comprising:

a frame;

a diaphragm comprising a pair of elongate resilient webs having intermediate portions joined to each other to form a movable expanse extending substantially in a plane, the expanse being movable in the direction of the plane, the webs each having opposing end portions connected to the intermediate portion, the end portions extending from the intermediate portion in opposite arcs and securing to adjacent frame locations to form a substantially cylindrically shaped web, the frame locations for one web being substantially aligned through the expanse with the frame locations for the other web;

coil means attached to the expanse of the diaphragm;

magnetic means for producing opposing magnetic fields extending normal to the expanse; and connecting means for conducting electrical impulses to the coil means.

9. An audio transducer, comprising:

a frame;

a diaphragm comprising a pair of elongate resilient webs having intermediate portions joined to each other to form a movable expanse extending substantially in a plane, the expanse being movable in the direction of the plane, each web having opposing flexible end portions extending from its intermediate portion in opposite arcs to remote adjacent frame locations to form a substantially cylindrically shaped web;

coil means attached to the expanse of the diaphragm;

magnetic means for producing opposing magnetic fields extending normal to the expanse through the coil means; and connecting means for conducting electrical impulses to the coil means.

10. The audio transducer of claim 9 wherein the frame includes bottom and top members having a segmented edge to minimize distortion.

11. The audio transducer of claim 9 wherein the diaphragm comprises polyvinyl fluoride film.

* * * * *